US010093097B2

(12) United States Patent
Shklyarevskiy et al.

(10) Patent No.: US 10,093,097 B2
(45) Date of Patent: Oct. 9, 2018

(54) MULTI-CHIP PRINT HEAD

(71) Applicant: Océ-Technologies B.V., Venlo (NL)

(72) Inventors: Igor O. Shklyarevskiy, Venlo (NL); Klaas Verzijl, Venlo (NL); René J. Van Der Meer, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/431,484

(22) Filed: Feb. 13, 2017

(65) Prior Publication Data

US 2017/0157926 A1 Jun. 8, 2017

Related U.S. Application Data

(63) Continuation of application No. PCT/EP2015/069029, filed on Aug. 19, 2015.

(30) Foreign Application Priority Data

Aug. 26, 2014 (EP) ..... 14182321

(51) Int. Cl.
*B41J 2/14* (2006.01)
*B41J 2/155* (2006.01)

(52) U.S. Cl.
CPC ..... *B41J 2/1433* (2013.01); *B41J 2/155* (2013.01); *B41J 2202/19* (2013.01); *B41J 2202/20* (2013.01)

(58) Field of Classification Search
CPC ..... B41J 2/1433; B41J 2/155
See application file for complete search history.

(56) References Cited

U.S. PATENT DOCUMENTS 6,378,995 B1 * 4/2002 Yun ..... B41J 2/162 347/70
6,457,811 B1 10/2002 Pan et al.
(Continued)

FOREIGN PATENT DOCUMENTS

EP 0 652 107 A2 5/1995
EP 0 666 174 A2 8/1995
(Continued)

*Primary Examiner* — Jason Uhlenhake
(74) *Attorney, Agent, or Firm* — Birch, Stewart, Kolasch & Birch, LLP

(57) ABSTRACT

A print head includes a plurality of chip-like tiles arranged on a common substrate, each tile having a front face with an array of recording elements disposed in the front face in a predetermined pattern, and a generally rectangular contour with a cut-out formed at at least one of its four corners, each cut-out being delimited by two reference-defining walls extending normal to one another and to the front face and serving as a reference for positioning the tiles on the substrate so as to establish a predetermined positional relationship between the recording elements of the different tiles. The substrate has a plurality of recesses accommodating each at least a part of a tile and having side walls that define engagement surfaces for each of the reference-defining walls of each tile, the substrate is formed of a material that is suitable for photo-lithographic processing, and the engagement surfaces of the substrate are surfaces formed by photo-lithographic techniques.

17 Claims, 2 Drawing Sheets

(56) References Cited

U.S. PATENT DOCUMENTS

| | | | | |
|---|---|---|---|---|
| 2005/0116995 | A1* | 6/2005 | Tanikawa | B41J 2/14024 347/56 |
| 2005/0174388 | A1* | 8/2005 | Miyamoto | B41J 2/14129 347/56 |
| 2007/0019038 | A1 | 1/2007 | Lee et al. | |
| 2008/0297006 | A1* | 12/2008 | Wijngaards | B41J 2/14233 310/365 |
| 2010/0149283 | A1 | 6/2010 | Miyazaki | |

FOREIGN PATENT DOCUMENTS

| | | | |
|---|---|---|---|
| EP | 0 921 003 | A1 | 6/1999 |
| EP | 2 052 861 | A1 | 4/2009 |

* cited by examiner

MULTI-CHIP PRINT HEAD

CROSS REFERENCE TO RELATED APPLICATIONS

This application is a Continuation of PCT International Application No. PCT/EP2015/069029, filed on Aug. 19, 2015, which claims priority under 35 U.S.C. 119(a) to patent application Ser. No. 14/182,321.1, filed in Europe on Aug. 26, 2014, all of which are hereby expressly incorporated by reference into the present application.

The invention relates to a print head comprising a plurality of chip-like tiles arranged on a common substrate, each tile having a front face with an array of recording elements disposed in the front face in a predetermined pattern, and a generally rectangular contour with a cut-out formed at at least one of its four corners, each cut-out being delimited by two reference-defining walls extending normal to one another and to the front face and serving as a reference for positioning the tiles on the substrate so as to establish a predetermined positional relationship between the recording elements of the different tiles.

EP 0 666 174 A2 discloses an ink jet print head of this type wherein the cut-outs of the tiles are complementary to one another and the tiles are held in direct engagement with one another in a common recess of the substrate.

The recording elements may be formed by nozzles that are connected to respective actuators for expelling ink droplets onto a recording medium. Other examples of ink jet print heads of this type have been described in EP 0 921 003 A1 and EP 2 052 861 A1.

The tiling technique, wherein the recording elements are distributed onto a plurality of tiles, has the advantage that a print head with relatively large dimensions, e.g. a print head extending over the entire width of a media sheet, can be established at relatively low costs, because the production process is facilitated by having to produce only tiles of a relatively limited size in which the recording elements are formed. However, a high positional accuracy is required for arranging the tiles on the common substrate in the correct positions so that, for example, the recording elements may be arranged in rows with uniform spacings between the individual recording elements, even at the borders between adjacent tiles.

In the known print head, the tiles are butted one against the other, so that the engaging side walls of the tiles may directly serve as a reference for defining the position of one tile relative to its neighbour. In this case, however, some of the recording elements must be formed in close proximity to the end walls of the tiles in order to be able to obtain a uniform spacing of the recording elements.

In another type of known print heads, the tiles are staggered in a scanning direction normal to the rows of recording elements, and the relative offset of the recording elements of different tiles is compensated for by appropriately controlling the timings at which the recording elements are fired when the print head scans the recording medium. In this case, a correct positioning of the tiles is difficult because the tiles do not directly engage one another.

It is an object of the invention to improve the positional accuracy with which the tiles of a print head can be arranged on the common substrate.

In order to achieve this object, the invention is characterized in that the substrate has a plurality of recesses accommodating each at least a part of a tile and having side walls that define engagement surfaces for each of the reference-defining walls of each tile, the substrate is formed of a material that is suitable for photo-lithographic processing, and the engagement surfaces of the substrate are surfaces formed by photo-lithographic techniques.

Thus, according to the invention, the engagement surfaces that define the positions of all tiles can be formed with high accuracy in one and the same member, i.e. the common substrate. Consequently, when the tiles are inserted in the recesses of the common substrate with their reference-defining walls engaging the engagement surfaces, the positions of the tiles, and, consequently, the positions of the recording elements formed therein, are defined with high accuracy.

More specific optional features of the invention are indicated in the dependent claims.

The engagement surfaces in the recess or recesses of the common substrate are formed by photo-lithographic techniques (masking and etching), which permits to determine the positions of the engagement surfaces with very high accuracy. For the same reason, it is preferable that the reference-defining walls of the tiles are also formed by photo-lithographic techniques, which is particularly convenient when the chip-like tiles are constituted by MEMSs (Micro-Electro-Mechanical Systems) which are produced by means of photo-lithographic techniques, anyway.

Since the reference-defining walls of the tiles are formed by rectangular cut-outs at the corners of each tile, the etching process may be limited to the relatively small sized corner portions of the tiles whereas the major part of the side walls of the tile, i. e. the parts extending between the corner portions, may be formed more efficiently but with less accuracy by means of dicing cuts or the like.

It is not necessary that the tiles are accommodated completely in the recess or recesses of the common substrate. It is sufficient when they are fitted into the recesses with only a part of their dimension in thickness direction, which further limits the amount of material to be etched away for forming the reference-defining walls and the corresponding engagement surfaces in the substrate. On the other hand, taking common inkjet print head maintenance operations like wiping into consideration, it may be advantageous to have the tiles accommodated completely, thereby forming a flat surface with the common substrate. Such a flat surface simplifies any maintenance operations on such a surface.

Embodiment examples will now described in conjunction with the drawings, wherein.

Figure 1:
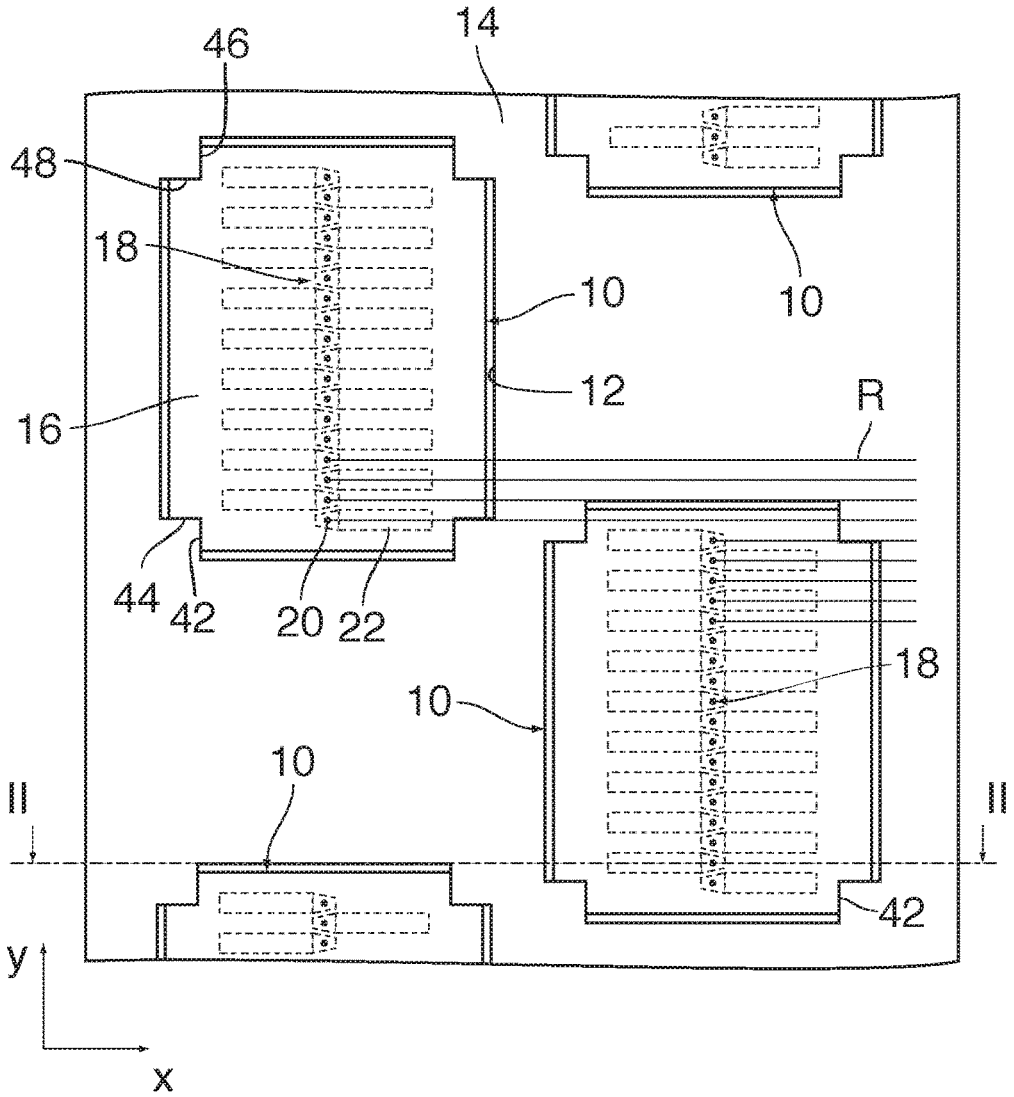
FIG. 1 is a view showing front faces of several tiles of a print head according to the invention.

As is shown in FIG. 1, an ink jet print head comprises a plurality of tiles 10 that are fitted in respective recesses 12 of a common substrate 14 such that front faces 16 of the tiles are exposed at the surface of the substrate. The substrate 14 may for example be formed by an etchable material such as silicon, so that the recesses 12 may be formed by means of a photo-lithographic technique (masking, exposure and etching).

An array 18 of recording elements is formed in the front face 16 of each of the tiles 10. As is well known for ink jet printers, the recording elements take the form of nozzles 20 each of which is connected to an actuator system 22 that is formed inside of the tile 10 and may be energized to form an ink droplet that will then be expelled through the nozzle 20 in the direction towards the viewer in FIG. 1 (the direction z in FIG. 2).

Further, in this example, each array 18 is formed by a single row of the nozzles 20, which extends in a direction y and in which the nozzles are disposed with uniform spacings from nozzle to nozzle.

The tiles 10 are staggered in two parallel rows (extending in y-direction) such that the rows of nozzles 20 of adjacent tiles are offset in the direction x (scanning direction) normal to the x-direction and the arrays 18 of the tiles 10 that belong to the same one of the two parallel rows are aligned with one another. Moreover, the positions of the tiles 10 and the recesses 12 in the direction x have been selected such that the positions of the nozzles 20 form a continuous raster that extends across the borders of the individual tiles, as has been indicated by horizontal lines R in FIG. 1. Thus, when the print head is moved relative to a media sheet in the direction x, and the actuators 20 of the tiles 10 are actuated at appropriate timings, it is possible to print a continuous straight line each pixel of which has been formed by means of one of the nozzles 20 of the various tiles.

Figure 2:
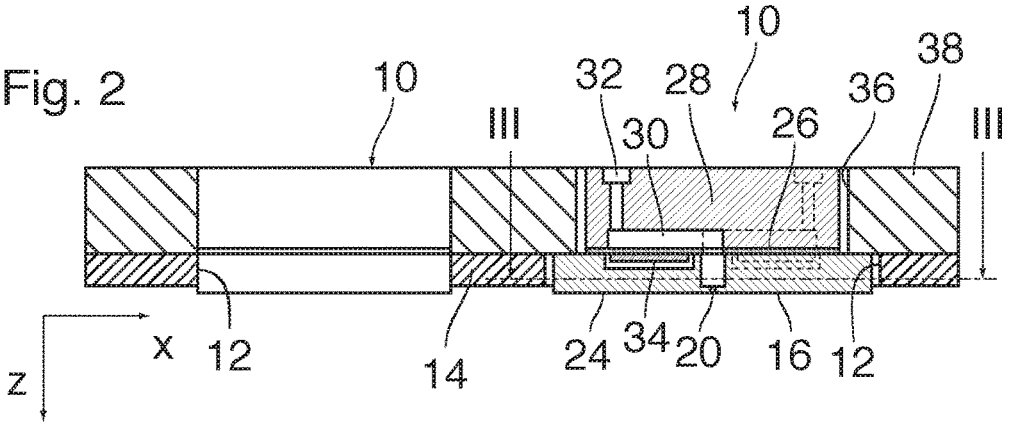
FIG. 2 is a cross-sectional view taken along the line II-II in FIG. 3.

As is shown in FIG. 2, each individual tile 10 has a layered structure composed of essentially three layers, i.e. a nozzle plate 24, a flexible membrane 26 and a distribution plate 28. The nozzles 20 are formed in a surface of the nozzle plate 24 that constitutes the front face 16 of the tile. Each nozzle 20 is individually connected to a pressure chamber 30 that is formed inside the distribution plate 28 and adjacent to the membrane 26. Further, the distribution plate 28 forms a distribution system 32 by which liquid ink can be supplied to each of the pressure chambers 30. In a position opposite to the pressure chamber 30 the nozzle plate 24 forms a cavity that accommodates a piezoelectric actuator 34. The actuator 34 is attached to the flexible membrane 26 and, when energized, causes the membrane to flex so as to create a pressure wave in the liquid ink in the pressure chamber 30. This pressure wave propagates towards the nozzle 20 and will cause an ink droplet to be expelled from the nozzle as is well known in the art of ink jet printing.

The actuator systems 22 shown in FIG. 1 are mainly constituted by the pressure chambers 30 and the actuators 34 and are alternatingly arranged on opposite sides of the nozzle row in order to permit a sufficiently small nozzle-to-nozzle distance. In a practical embodiment (not shown) an individual tile 10 may be provided with multiple rows of nozzles 20. In particular, such multiple rows may have the nozzles 20 in a staggered arrangement for virtually forming a single row of nozzles. In general, the present invention is not limited to a particular arrangement of nozzles 20 in an individual tile 10. The present invention is directed at providing a method and device that provide tiles 10 positioned highly accurately relative to each other.

In the example shown in FIG. 2, the nozzle plate 24 of the tile 10 is accommodated in the recess 12 of the substrate 14 but has a thickness slightly larger than that of the substrate 14, so that the front face 16 slightly projects beyond the surface of the substrate 14. The membrane 26 and the distribution plate 28 have a width that is smaller than the width of the nozzle plate 24 and are accommodated in a recess 36 of a carrier plate 38 that may be made of graphite, ceramics, glass or the like.

Figure 3:
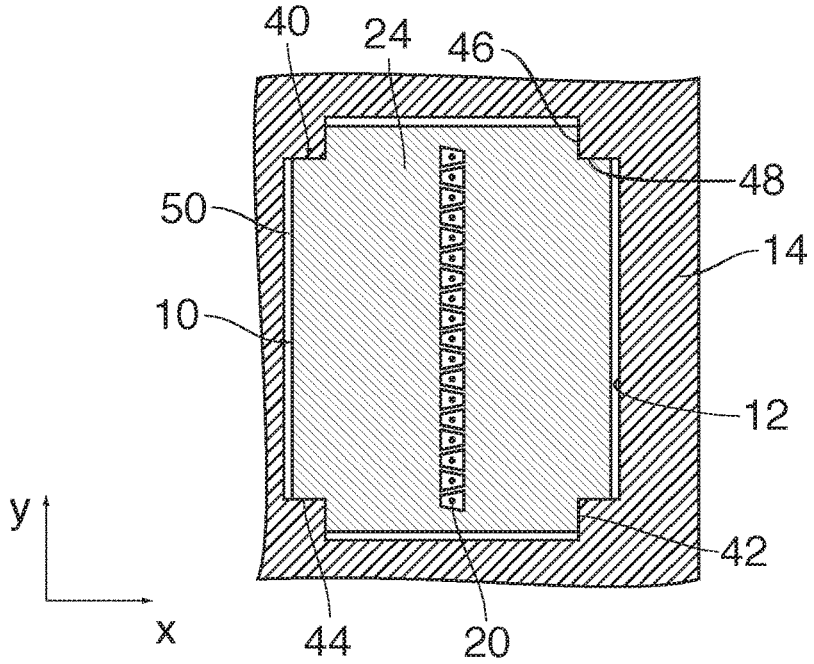
FIG. 3 is a sectional view taken along the line III-III in FIG. 2.

As can be seen more clearly in FIG. 3, the part of the tile 10 that is constituted by the nozzle plate 24 has rectangular cut-outs 40 formed in each of its four corners. The walls of each of these four cut-outs 40 form an x-direction reference-defining wall 42 and a y-direction reference-defining wall 44 of the tile 10. These reference-defining walls 42 and 44 extend orthogonally to one another and are also orthogonal to the front face 16 of the tile. The cut-outs 40 are formed by means of photo-lithographic techniques, so that the positions of the walls 42 and 44 can be defined with very high accuracy, e.g. with tolerances of ±2 μm or less.

If it is desired to have the nozzles 20 positioned highly accurate relative to the nozzles provided in another tile, it is advantageous to use the same means to form the cut-outs 40 as the nozzles 20. In particular, in a MEMS-based inkjet tile, the nozzles 20 are usually provided by photo-lithographic techniques. In such processing, a mask is provided on the nozzle plate 24 and the nozzles 20 are etched. In such an embodiment, the position of the cut-outs 40 relative to the nozzles 20 is highly accurate if the cut-outs 40 are etched using the same mask. So, in an embodiment, any reference-defining walls of the tile 10, such as the cut-outs 40, are provided together with the nozzles 20 in a single photo-lithographic step, in particular by etching using a single mask.

The corners of the recess 12 have structures that are complementary to the cut-outs 40 and form engagement surfaces 46 for the walls 42 and engagement surfaces 48 for the walls 44. The engagement surfaces 46 and 48 in the recess 12 are also formed by photo-lithographic techniques and their positions may also be defined with an accuracy of 2 μm or less, so that the total tolerance with which the tiles 10 can be positioned relative to one another in both the x-direction and the y-direction can be made as small as 4 μm or less.

It should be observed that the cut-outs 40 need to be formed only in those parts of the nozzle plate 24 that are received in the recess 12, whereas the part that projects out of the recess 12 and forms the front face 16 may optionally have a perfectly rectangular contour.

At the four sides of the tile 10 between the corner cut-outs 40, the side walls of the nozzle plate 24 form respective gaps 50 with the side walls of the recess 12. These gaps may optionally be filled with an adhesive.

Figure 4:
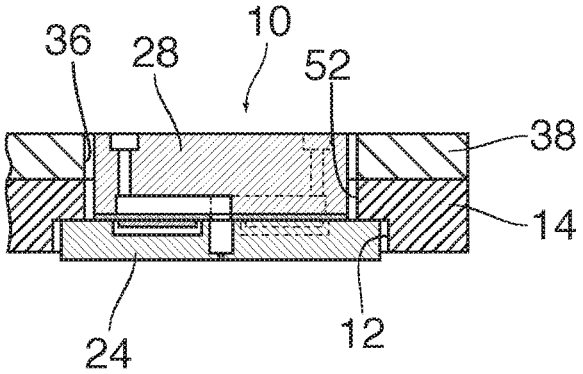
FIG. 4 is a partial sectional view analogous to FIG. 2, showing a tile of a print head according to another embodiment of the invention.

FIG. 4 shows an embodiment in which the substrate 14 has a larger thickness than the nozzle plate 24. Adjacent to the shallow recess 12 that accommodates the nozzle plate 24, another recess 52 is formed in the substrate 14 for accommodating at least a part of the distribution plate 28 of the tile. The recess 52 may form a clearance with the distribution plate 28 on the entire periphery of the tile 10, i.e. the engagement walls 46 and 48 need to be formed only in the shallow recess 12 but not in the deeper recess 52.

Figure 5:
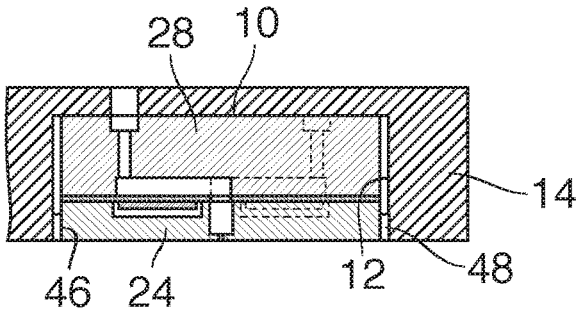
FIG. 5 is a partial sectional view showing yet another embodiment.

Whereas, in the embodiments shown in FIGS. 2 and 4, the recess 12 and the combined recesses 12 and 52, respectively, form a through-hole in the substrate 14, FIG. 5 illustrates an embodiment where the substrate 14 has an even larger thickness, larger than the total thickness of the tile 10, and the recess 12 accommodates both the nozzle plate 24 and the distribution plate 28 but does not penetrate the substrate 14 in its entirety. Still, the engagement walls 46 and 48 may be formed only over a part of the depth of the recess 12 so as to engage the reference-defining walls 42 and 44 at the nozzle plate 24.

Further, FIG. 5 is illustrative of an example where the distribution plate 28 has the same width (and actually the same contour) as the nozzle plate 24. In this case, the cut-outs 40 are also formed in the corners of the distribution plate 28 in order to be able to insert the tile 10 into the recess 12.

While, in the embodiments shown here, each of the tiles is accommodated in a separate recess 12 of the substrate 14, the recesses that accommodate the different tiles 10 may also be merged with one another so as to form only a single large recess, for example, provided of course that engagement walls 46 and 48 are still provided for each of the tiles.

The invention claimed is:

1. A print head comprising:

a plurality of chip-like tiles arranged on a common substrate, each tile having a front face with an array of recording elements disposed in the front face in a predetermined pattern; and a generally rectangular contour with a cut-out formed at at least one of its four corners, each cut-out being delimited by two reference-defining walls extending normal to one another and to the front face and serving as a reference for positioning the tiles on the substrate so as to establish a predetermined positional relationship between the recording elements of the different tiles, wherein the substrate has a plurality of recesses, each recess accommodating a tile and having a size and shape complimentary to a size and shape of the tile, and wherein each tile comprises a nozzle plate, a flexible membrane and a distribution plate.

2. The print head according to claim 1, wherein each tile is constituted by a MEMS-chip.

3. The print head according to claim 2, wherein at least two corners of each tile are formed with a rectangular cut-out forming the reference-defining walls.

4. The print head according to claim 2, wherein the front face of each tile projects from the recess, and the cut-outs are formed only in those parts of the tile that are received within the recess.

5. The print head according to claim 2, wherein the recess forms part of a through-hole that penetrates the substrate.

6. The print head according to claim 1, wherein at least two corners of each tile are formed with a rectangular cut-out forming the reference-defining walls.

7. The print head according to claim 6, wherein the front face of each tile projects from the recess, and the cut-outs are formed only in those parts of the tile that are received within the recess.

8. The print head according to claim 1, wherein the front face of each tile projects from the recess, and the cut-outs are formed only in those parts of the tile that are received within the recess.

9. The print head according to claim 1, wherein the recess forms part of a through-hole that penetrates the substrate.

10. The print head according to claim 1, wherein each tile comprises a layered structure composed of at least three layers.

11. The print head according to claim 1, wherein substrate is formed of silicon.

12. The print head according to claim 1, further comprising a piezoelectric actuator attached to the flexible membrane, the actuator causing the membrane to flex to create a pressure wave in the ink in a pressure chamber formed in the distribution plate to expel ink droplets from one of the nozzles.

13. A method of forming a print head comprising a plurality of chip-like tiles arranged on a common substrate, each tile having a front face with an array of recording elements disposed in the front face in a predetermined pattern, and a generally rectangular contour with a cut-out formed at least one of its four corners, each cut-out being delimited by two reference-defining walls extending normal to one another and to the front face and serving as a reference for positioning the tiles on the substrate so as to establish a predetermined positional relationship between the recording elements of the different tiles, said method comprising the steps of:

forming a plurality of recesses in the substrate;

using photo-lithographic techniques for forming engagement surfaces for the reference-defining walls of the tiles at side walls of each recess; and inserting and positioning each tile in one of the recesses, wherein each recess has a size and shape to a size and shape of the tile accommodated therein, wherein the tile is provided with a nozzle plate having a nozzle arranged therein and wherein the nozzle and the reference-defining walls are formed in a single photo-lithographic step, and wherein the nozzle and the reference-defining walls are formed by etching using a single etching mask.

14. The method according to claim 13, wherein the reference-defining walls of each tile are formed by means of photo-lithographic techniques.

15. A print head comprising:

a substrate;

a plurality of tiles arranged on the substrate in two rows separated from one another in a first direction, each tile having a front face with an array of nozzles disposed in the front face in a row extending in a second direction, wherein the nozzles of the tiles in the two rows are equally separated from one another in the second direction to form a continuous raster.

16. The print head according to claim 15, wherein a second to last nozzle in the row of a tile in a first column is aligned with an end edge of a tile in a second column.

17. The print head according to claim 15, wherein each tile has a generally rectangular contour with a pair of cut-outs formed at corners of the tiles, each cut-out having an edge extending in the first direction and parallel to an end edge of the tile, wherein a last nozzle in the row of a tile in a first column is aligned with the edges of the cut outs.

* * * * *